United States Patent [19]

Laempe

[11] Patent Number: 4,828,461

[45] Date of Patent: May 9, 1989

[54] APPARATUS FOR METERING FLOWABLE MATERIALS IN SAND CORE MAKING MACHINES

[75] Inventor: Joachim Laempe, Schopfheim, Fed. Rep. of Germany

[73] Assignee: Dipl. Ing. Laempe GmbH, Schopfheim, Fed. Rep. of Germany

[21] Appl. No.: 109,459

[22] Filed: Oct. 16, 1987

[30] Foreign Application Priority Data

Oct. 18, 1986 [DE] Fed. Rep. of Germany ..... 3635539

[51] Int. Cl.[4] ..... F04F 1/02; F04F 1/14

[52] U.S. Cl. ..... 417/132; 417/129; 417/135; 417/136; 417/138; 417/149

[58] Field of Search ..... 417/120, 129, 130, 131, 417/132, 135, 136, 138, 149

[56] References Cited

U.S. PATENT DOCUMENTS

| | | | |
|---|---|---|---|
| 1,323,864 | 12/1919 | Human | 417/132 X |
| 2,141,427 | 12/1938 | Bryant | 417/120 |
| 2,400,651 | 5/1946 | Marsh | 417/120 |
| 3,005,417 | 10/1961 | Swaney | 417/138 X |
| 3,556,682 | 1/1971 | Sakamoto et al. | 417/138 X |
| 3,861,830 | 1/1975 | Johnson | 417/149 |
| 4,439,110 | 3/1984 | Massaux | 417/138 X |

FOREIGN PATENT DOCUMENTS

| | | | |
|---|---|---|---|
| 0023368 | 2/1980 | Japan | 417/138 |

*Primary Examiner*—John Rivell
*Attorney, Agent, or Firm*—Peter K. Kontler

[57] ABSTRACT

Apparatus for transferring metered quantities of a flowable bonding agent from a tank into a mixer of a sand core making machine has an upright tubular vessel into which the bonding agent is drawn from the tank by a suction pump and a pressure pump which transfers the accumulated bonding agent from the vessel into the mixer. The vessel contains a float which cooperates with sensors serving to generate signals for actuation or deactivation of the pumps and/or valves in the conduits connecting the vessel with the tank, mixer and the pumps. The bonding agent is kept out of contact with the pumps and out of contact with the valves in the conduits connecting the vessel with the pumps.

20 Claims, 1 Drawing Sheet

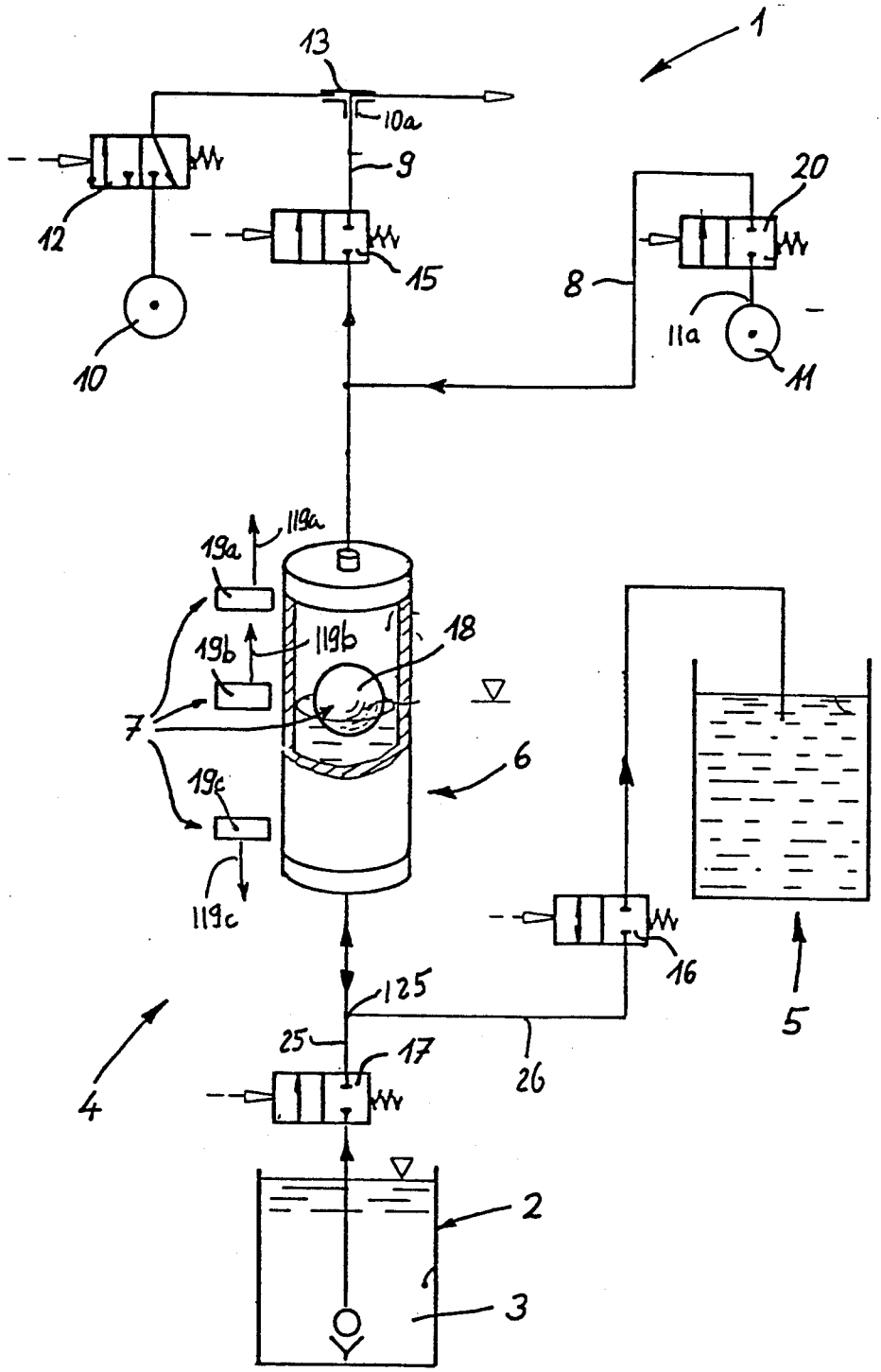
1
13
10a
9
12
15
20
8
11a
11
10
119a
19a
19b
119b
18
7
6
19c
119c
16
5
125
25
17
26
4
2
3

APPARATUS FOR METERING FLOWABLE MATERIALS IN SAND CORE MAKING MACHINES

BACKGROUND OF THE INVENTION

The invention relates to metering apparatus in general, and more particularly to improvements in apparatus which can be used to meter flowable materials in sand core making machines, especially for metering aggressive liquid bonding agents in such machines.

It is customary to transfer metered quantities of a liquid bonding agent from a source of such medium into a mixing unit. The arrangement is normally such that the bonding agent is transferred by pressurization and/or under the action of gravity. As a rule, the means for transferring metered quantities of bonding agent to the mixing unit includes a diaphragm pump or a piston pump. The metering action of a diaphragm pump is determined by appropriate selection of the frequency and extent of deformation of the diaphragm and is a function of the length of the interval of operation of the thus adjusted diaphragm pump. The adjustment is simpler in connection with a piston type pump because the quantity of displaced bonding agent is directly dependent on the number of strokes of the pump piston. A piston pump which is used in conventional metering apparatus is disclosed in German Offenlegungsschrift No. 2 262 254 of Michel. The bonding agent comes in direct contact with the internal surface of the cylinder and with the piston of the pump.

The just outlined metering apparatus exhibit a number of serious drawbacks when they are called upon to deliver metered quantities of customarily employed bonding agents for sand in sand core making machines of foundries or like plants. Thus, a diaphragm pump is simply incapable of metering a bonding agent with a requisite degree of accuracy, primarily or at least in part because the seals in such pumps are rapidly damaged or totally destroyed by the often highly aggressive bonding agent. The situation is analogous when the metering means is a piston pump, i.e., the bonding agent rapidly damages or destroys the seals. Moreover, the bonding agent is likely to affect the condition of surfaces in the regions of sliding contact between the piston or pistons and the associated cylinder or cylinders (not the Michel reference). The resulting leaks allow for penetration of air which further affects the accuracy of the metering action. Furthermore, and even if a pump operates properly, it is highly unlikely to deliver, for a reasonably long period of time, metered quantities of bonding agent which comes into direct contact with its parts because and, even minute, leaks in the suction pipe which connects the source of bonding agent with the pump will immediately affect the accuracy of the metering action because air can be drawn into the pump chamber to thus effect a reduction of the quantity of bonding agent which is withdrawn from the source. The remedial action necessitates a lengthy interruption of the operation of the pump in order to evacuate air from the pump chamber and/or to replace or repair the suction pipe.

OBJECTS AND SUMMARY OF THE INVENTION

An object of the invention is to provide a novel and improved apparatus which is constructed and assembled in such a way that its sensitive parts (such as the pump or pumps) need not be contacted by the conveyed flowable material.

Another object of the invention is to provide an apparatus whose metering action remains unchanged for long periods of time.

A further object of the invention is to provide an apparatus of the above outlined character which can effectively meter highly aggressive flowable materials and whose operation can be automated to any desired extent.

An additional object of the invention is to provide an apparatus wherein penetration of air into the conduits which connect various components of the apparatus does not adversely influence the metering action or is less detrimental than in conventional apparatus.

Still another object of the invention is to provide the apparatus with novel and improved means for drawing flowable material from the source of such material and for forcing the withdrawn material to enter the receptacle for storage or processing of metered quantities of the material.

A further object of the invention is to provide a novel and improved method of shielding pumps or analogous fluid flow machines from damage while the pumps are used to convey an aggressive flowable material, such as a bonding agent for sand in sand core making machines.

Another object of the invention is to provide the above outlined apparatus with novel and improved means for automatically interrupting the evacuation of flowable material from its source when the quantity of evacuated material matches the prescribed or desired quantity.

A further object of the invention is to provide a sand core making machine which embodies the above outlined apparatus.

The invention is embodied in an apparatus for metering flowable materials, particularly aggressive liquid bonding agents for sand in core making machines. The apparatus comprises a tank or another suitable source of flowable material, a receptacle for metered quantities of flowable material (such receptacle can form apart of mixing unit wherein the flowable material is agitated, caused to interact with another material and/or otherwise treated), and means for transferring metered quantities of flowable material from the source to the receptacle. The transferring means comprises (first) conduit means serving to connect the source with the receptacle, a metering vessel in the conduit means, and pump means for effecting the flow of a selected quantity of flowable material from the source into the vessel and for thereupon effecting the flow of such selected quantity from the vessel into the receptacle.

The pump means can include a suction pump which serves to draw flowable material from the source into the vessel, and a pressure pump which serves to force flowable material from the vessel into the receptacle. Valved second conduit means is preferably provided to connect the vessel with the suction intake of the suction pump, and valved third conduit means can be provided to connect the vessel with the outlet of the pressure pump.

The transferring means further comprises means for selecting the quantity of flowable material which can flow from the source into the vessel, and such selecting means preferably comprises a mobile indicator of the quantity (e.g., level) of flowable material in the vessel and means for generating signals denoting the position of the indicator. The indicator can comprise a float, and such float can include or constitute a permanent magnet. The signal generating means can include at least one sensor which monitors the position of the permanent magnet. For example, the float can contain titanium; at least a portion of the external surface of the float can be defined by a layer of titantium. Signals which are generated by the signal generating means can be used to actuate (i.e., start, arrest accelerate and/or decelerate) the pump means.

The vessel can be made of or can contain a plastic material which is capable of resisting the corrosive and/or other influences of conveyed flowable material. In accordance with a presently preferred embodiment, the vessel includes a substantially upright tube with a diameter of 20–50 mm and a height of at least 0.2 m, e.g., approximately 1 m.

Adjustable valve means are preferably provided in the first conduit means between the source and the vessel as well as between the vessel and the receptacle. Signals which are generated to denote the quantity of flowable material in the vessel can be used to start or arrest the one and/or the other pump and/or to open or close and/or otherwise adjust one or more valve means, such as the valve means in the first conduit means and/or the valve means in the second and/or third conduit means. For example, when the vessel is empty, the suction pump can receive a signal to start drawing flowable material from the source into the vessel; at such time, the valve means in the second conduit means and in the first conduit means between the source and the vessel are open and all other valve means can remain closed. When the signal or signals from the quantity selecting means denote that the vessel has accumulated a prescribed quantity of flowable material, the corresponding signal or signals are used to arrest the suction pump, to start the pressure pump, the close the valve means in the second conduit means and in the first conduit means between the source and the vessel, to open the valve means in the first conduit means between the vessel and the receptacle, and to open the valve means in the third conduit means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single Figure of the drawing is a diagrammatic partly perspective and partly vertical sectional view of an apparatus which embodies one form of the invention and wherein the level indicator is a float installed in a narrow upright tubular vessel and cooperating with three signal generating sensors.

DESCRIPTION OF THE PREFERRED EMBODIMENTS

The apparatus 1 which is shown in the drawing serves to transfer metered quantities of a flowable liquid material 3 (particularly a bonding agent for sand in a sand core making machine, e.g., a machine of the type disclosed in applicant's copending U.S. patent applications Ser. Nos. 082,789 and 082,847 filed Aug. 6, 1987) from a source 2 of such material into the receptacle 5 of a mixing unit. The transferring unit 4 which actually effects the transfer of metered quantities of bonding agent 3 from the source 2 (such as a tank wherein the supply of bonding agent can be replenished continuously or from time to tome) includes a fists conduit including pipes 25, 26 and a metering vessel 6 in the form of an upright tube or cylinder which is installed in the first conduit 25, 26 in such a way that any bonding agent 3 which is to be transferred into the receptacle 5 must flow first from the tank 2 into the vessel 6 and thereupon from the vessel 6 into the receptacle 5. To this end, the conduit 25, 26 contains two adjustable valves including a solenoid valve 17 which controls the flow of bonding agent 3 from the tank 2 into the vessel 6 and a second valve 16 which controls the flow of bonding agent from the vessel 6 into the receptacle 5.

The inner diameter of the vessel 6 need not be less than 20 mm and need not exceed 50 mm, and the height of the vessel preferably exceeds 0.2 m; for example, the vessel 6 can be 1 m high.

The transferring unit 4 further comprises a device 7 which serves to select the quantity of bonding agent 3 which is transferred from the tank 2 into the vessel 6, and a pump assembly including two discrete pumps 10, 11 one of which serves to draw bonding agent 3 from the tank 2 into the vessel 6 and the other of which serves to force bonding agent from the vessel 6 into the receptacle 5. A second conduit 9 is provided to connect the upper portion of the vessel 6 with the suction intake **10*a* of the pump 10 which latter can be termed a suction pump even though it actually conveys a pressurized fluid (such as air) through a solenoid valve 12 and a venturi 13 so that the venturi draws bonding agent 3 from the tank 2 into the vessel 6 by maintaining the intake 10*a* at subatmospheric pressure. At such time, an adjustable solenoid valve 15 in the conduit 9 is open, the valve 17 is also open, the valve 16 in the portion 26 of the first conduit 25, 26 is closed, and a valve 20 in a third conduit 8 connecting the upper portion of the vessel 6 with the pressure pump 11 is also closed. Thus, when the pump 10 is in operation, it causes the venturi 13 to draw air from the vessel 6 into the conduit 9 whereby the bonding agent 3 flows from the tank 2 into the vessel 6 to lift a float 18 which constitutes a mobile indicator of the quantity selecting device 7 and cooperates with several sensors 19*a*, 19*b*, 19*c* which are adjacent the vessel 6 at different levels. At least a portion of the float 18 can constitute a permanent magnet, and each of the sensors 19*a*–19*c* can include or constitute an electromagnet which generates a signal denoting the level (and hence the quantity) of bonding agent 3 in the vessel 6. Means (denoted by arrows 119*a*, 119*b* and 119*c*) are provided to transmit signals to the pumps 10, 11 and valves 12, 15, 16, 17 and 20 of the metering apparatus 1 during different stages of operation. The sensors 19*a*–19*c* react to changes of the electromagnetic field which are caused by the rising or descending float 18 and they generate signals which are indicative of the level of the float and hence of the quantity of bonding agent 3 in the vessel 6. The operative connection 119*a* can be designed to transmit a signal to deenergize the solenoid of the valve 15 when the vessel 6 contains a predetermined quantity of bonding agent 3 so that the pump 10 ceases to draw bonding agent from the tank 2 into the vessel 6, and the signal from 119*a* is further used to close the valve 17, to open the valves 16 and 20 and to start the pump 11 so that the latter is free to force (expel) the metered quantity of bonding agent 3 from the vessel 6 into the receptacle 5. All this takes place while the bonding agent 3 is entirely out of contact with any parts of the pumps 10, 11, venturi 13 and valves 15, 20. Thus, only certain parts of the valves 16, 17 are directly contacted by the bonding agent. Such construction of the apparatus 1 ensures that the operation of the pumps 10, 11 is not affected by the bonding agent, and these pumps can operate properly for practically unlimited periods of time. Moreover, the presence of leaks in the conduit 8 and/or 9 is of no consequence because the sensor 19*a* causes the signal transmitting means 119*a* to arrest or to deactivate the pump 10 only when the vessel 6 already contains a metered quantity of bonding agent 3, and the signal which is transmitted by the device 119*c* is caused to arrest or to deactivate the pump 11 only when the entire metered quantity of bonding agent has been transferred from the vessel 6 into the receptacle 5. The situation is different only if the leak in the conduit 8 and/or 9 is so pronounced that the pump 11 cannot force the bonding agent from the vessel 6 or that the pump 10 cannot draw bonding agent from the tank 2. The pump 11 can be designed to convey a compressed gaseous fluid (such as air) which flows through the valve 20 and enters the upper part of the vessel 6 to expel the accumulated metered quantity of bonding agent 3 into the receptacle 5. As mentioned above, the valves 16, 20 are then open and the valves 15, 17 are closed. Signals which are generated by the sensor 19b can be transmitted to the valve 15 (to close this valve) if the pump 11 is to be started or activated when the vessel 6 is halfway filled with bonding agent. It is clear that the quantity selecting device 7 can employ four, five or more sensors or that the number of sensors can be reduced to two by omitting the median sensor 19*b***.

The pump 11 and the valve 20 can be omitted if the apparatus 1 is modified by the provision of a bypass for the venturi 13 so that the pump 10 can draw bonding agent from the tank 2 into the vessel 6 when the venturi 13 is operative and that the pump 10 can force the accumulated metered quantity of bonding agent from the vessel 6 into the receptacle 5 when the venturi 13 is bypassed, i.e., when the pump 10 can force a pressurized gaseous fluid into the vessel 6.

It is possible to provide a mechanical connection between the float 18 and one or more motors which actuate the valves and/or the pumps in a desired sequence, depending on the position of the float with reference to the vessel 6. The provision of a non-mechanical connection between the float 18 and one or more external components of the quantity selecting device 7 is preferred because this eliminates problems in connection with adequate sealing of the vessel 6 and those problems which could arise in connection with wear upon the mechanical motion transmitting parts. In order to render the float 18 sufficiently resistant to the corrosive and/or other undesirable action of an aggressive bonding agent, at least a portion of the external surface of the float can be defined by a layer of strongly corrosion-resistant material, such as titanium.

The utilization of a relatively long upright tubular vessel 6 is preferred at this time because the float 18 is then compelled to change its position (level) in response to relatively small changes in the quantity of bonding agent 3 in the vessel, i.e., the quantity selecting device 7 is more sensitive. the vessel 6 can be made, at least in part, of a suitable plastic material which can stand the corrosive and/or other influences of the bonding agent. As mentioned above, the inner diameter of the tubular vessel 6 is preferably less than 51 mm and its height is preferably in excess of 0.2 m and can be well in excess of 1 m.

The float 18 and the sensors **19*a*–19*c* can be replaced with other types of quantity selecting means without departing from the spirit of the invention. For example, a coil-shaped inductance can be convoluted around the vessel 6 to replace the float 18. Such inductance cooperates with one or more sensors to initiate the generation of signals which denote the quantity of bonding agent in the vessel 6**.

An important advantage of the improved apparatus 1 is that the operation of the pump or pumps cannot be affected by the bonding agent and that such bonding agent is further incapable of affecting the operation of several valves (such as the valve 12, 15 and 20). This ensures that the accuracy of the metering operation is practically unaffected by the chemical and/or other properties of the conveyed flowable material. Still further, the bonding agent is much less likely to accumulate in certain conduits and to thereby affect the accuracy of the metering operation. Thus, the operation of the pump 10 and venturi 13 can be readily selected in such a way that the bonding agent does not rise into the conduit 9, and the pressure of gaseous fluid which is conveyed by the pump 11 to expel bonding agent from the vessel 6 can be readily selected in such a way that such gaseous fluid expels all of the bonding agent from the vessel 6, from the common part of portions 25, 26 of the first conduit and from that part of the portion 26 which extends from the junction 125 to the valve 16. This holds true regardless of the consistency of the bonding agent, e.g., even if the bonding agent is a highly viscous substance which tends to adhere to the internal surface of the vessel 6 and/or to the internal surface of the composite conduit 25, 26. A highly viscous bonding agent would be likely to adversely influence the operation of the pump 10 and/or 11 if it were permitted to come in direct contact with the parts of such pumps.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for metering flowable bonding agents for sand in core making machines, comprising a source of bonding agent; a receptacle for metered quantities of flowable bonding agent; and means for transferring metered quantities of flowable bonding agent form said source to said receptacle, including conduit means connecting said source with said receptacle, a metering vessel, connected to said conduit means between said source and said receptacle, and means for effecting the flow of a selected quantity of flowable bonding agent from said source into said vessel by way of said conduit means for thereupon effecting the flow of such selected quantity from said vessel and from said conduit means connected between said vessel and said receptacle into said receptacle.

2. The apparatus of claim 1, further comprising a mixing unit for said selected quantity of flowable bonding agent, said receptacle forming part of said mixing unit.

3. The apparatus of claim 1, wherein said flow effecting means comprises a suction pump arranged to draw flowable bonding agent from said source into said vessel and into said conduit means between said source and said vessel, and a pressure pump arranged to force flowable bonding agent from said vessel and from said conduit means between said vessel and said receptacle into said receptacle.

4. The apparatus of claim 3, wherein said suction pump has a suction intake and said pressure pump has an outlet, said transferring means further comprising valved second conduit means connecting said vessel with the intake of said suction pump and valved third conduit means connecting said vessel with the outlet of said pressure pump.

5. The apparatus of claim 1, wherein said transferring means further comprises means for selecting the quantity of flowable bonding agent which can flow from said source into said vessel.

6. The apparatus of claim 5, wherein said selecting means comprises a mobile indicator of the level of flowable bonding agent in said vessel, and means for generating signals denoting the position of said indicator, said signal generating means being located externally of said vessel.

7. The apparatus of claim 6, wherein said indicator includes a float.

8. The apparatus of claim 7, wherein said float includes a permanent magnet.

9. The apparatus of claim 8, wherein said signal generating means includes at least one sensor which monitors the position of said magnet.

10. The apparatus of claim 7, wherein said float contains titanium.

11. The apparatus of claim 10, wherein said float has an external surface and a layer of titanium defining at least a portion of said surface.

12. The apparatus of claim 5, wherein said selecting means includes means for generating signals denoting the quantity of flowable bonding agent in said vessel, and means for actuating said flow effecting means in response to said signals.

13. The apparatus of claim 1, wherein said vessel is made at least in part of a plastic material which is resistant to the flowable material.

14. The apparatus of claim 1, wherein said vessel includes a substantially upright tube.

15. The apparatus of claim 14, wherein said vessel has a diameter of 20–50 mm.

16. The apparatus of claim 14, wherein said vessel has a height of at least 0.2 m.

17. The apparatus of claim 14, wherein said vessel has a height of approximately 1 m.

18. The apparatus of claim 1, further comprising first adjustable valve means in said conduit means between said vessel and said source and second adjustable valve means in said conduit means intermediate said vessel and said receptacle.

19. The apparatus of claim 18, wherein said flow effecting means includes a suction pump having a suction intake, a pressure pump having an outlet, second conduit means connecting said intake with said vessel and third conduit means connecting said vessel with said outlet, and further comprising third adjustable valve means in said second conduit means and fourth adjustable valve means in said third conduit means.

20. The apparatus of claim 19, wherein said transferring means further comprises means for selecting the quantity of flowable bonding agent which can flow from said source into said vessel, including a mobile indicator of the level of flowable bonding agent in said vessel, means for monitoring the portion of said indicator and for generating signals denoting the position of said indicator, said monitoring means being located externally of said vessel, and means for transmitting said signals to at least one of said pumps and/or to at least one of said valve means.

* * * * *